US006000503A

United States Patent [19]

Draper et al.

[11] Patent Number: 6,000,503

[45] Date of Patent: Dec. 14, 1999

[54] SLIDING TWO SPEED DOOR MECHANISM FOR AN ELEVATOR CAR

[75] Inventors: James M. Draper, Woodstock; James A. Rivera, Bristol, both of Conn.

[73] Assignee: Otis Elevator Company, Farmington, Conn.

[21] Appl. No.: 08/990,243

[22] Filed: Dec. 23, 1997

[51] Int. Cl.[6] ..... B66B 13/06

[52] U.S. Cl. ..... 187/324; 187/333

[58] Field of Search ..... 187/324, 333, 187/334

[56] References Cited

U.S. PATENT DOCUMENTS

| | | | |
|---|---|---|---|
| 1,751,058 | 3/1930 | Rosentreter | 187/333 X |
| 2,009,342 | 7/1935 | Nielson | 187/324 X |
| 2,106,926 | 2/1938 | Hammell | 187/334 X |
| 2,121,906 | 6/1938 | Dunn | 187/324 X |
| 2,637,549 | 5/1953 | Borden | 187/324 X |

*Primary Examiner*—William E. Terrell
*Assistant Examiner*—Gene O. Crawford

[57] ABSTRACT

A two door assembly (10) for an elevator car (11) includes a high speed door (12) and a low speed door (14) that move between an open and closed position to close the entrance (16) of the elevator car. The doors (12, 14) are retained slidably between a header (18) disposed along the top of the car entrance and a door guide (20) disposed along the bottom of the car entrance (16). A drive mechanism (22) moves the high speed and low speed doors (12, 14) between the open and closed positions. A drive arm (24) interconnects the doors to move the low speed door (14) at approximately one-half the speed of the high speed door (12) driven by the drive mechanism (22). One end (38) of the drive arm (24) is connected pivotally to the door guide (20) of the elevator car (11). Each door (12, 14) has a pin (32, 34) extending from a bracket (26, 28) connected to each respective door for sliding engagement with a pair of slots (42, 44) that extend longitudinally along the drive arm (24). The length of the slots (42,44) are sufficient to permit movement of the doors (12, 14) between the open and closed positions. The weight of the drive arm (24) at a predetermined center of gravity (50) provides a predetermined closing force ($F_{HC}$) to the high speed door (12) in the closed position and a reduced closing force ($F_{HO}$) to the high speed door in the open position.

18 Claims, 2 Drawing Sheets

SLIDING TWO SPEED DOOR MECHANISM FOR AN ELEVATOR CAR

FIELD OF THE INVENTION

The present invention relates to a door assembly for an elevator car, and more particularly to a two speed door mechanism having a weighted closing device for providing sufficient closing force to maintain the door assembly at a closed position but reduced closing force when the door assembly is at an open position.

BACKGROUND ART

For elevator systems it is known that a door assembly of an elevator car may include a high speed and a slow speed door. A two speed door mechanism interconnects the doors which controls their speed relative to each other. Currently two types of mechanisms are used to open and close the two speed door assembly. One type of mechanism uses multiple links to interconnect the low speed door, the high speed door and a drive motor. This mechanism requires a number of components which increase the time and cost to manufacture and assemble the door assembly.

Another two speed door mechanism uses cables and pulleys to control the operation of the doors. The cable design has proven to have inadequate stiffness necessary for smooth two door operation. The cable design also forces the mechanism to be installed in the header of the elevator car which is not possible for some elevator systems that do not have space in the header area for a cable arrangement.

In addition to controlling the movement of the doors, the door mechanism must also hold the doors closed at a constant force to comply with elevator codes. One current method is the use of a motor to provide constant force to the door assembly in the closed position. The use of motor force is undesirable because it consumes energy and provides additional heat to the system. Another method is the use of weight closers which provide a constant weight or force closing the door assembly. This method, however, is undesirable because the weights exert a constant closing force not only at the closed position but also at all positions. The driving motor must therefore continually overcome this constant closing force throughout the opening of the doors and thereby consume energy and provide additional heat to the system. Another method is the use of springs to provide a constant closing force when the door assembly is closed. Springs, however, can be noisy and introduce reliability problems.

DISCLOSURE OF THE INVENTION

The above-discussed and other drawbacks and deficiencies of the prior art are overcome or alleviated by the two speed door mechanism of the present invention.

According to the present invention, a door mechanism of a door assembly of an elevator car is provided having a high speed door and a slow speed door that slidably engage the elevator car. A drive mechanism moves the high speed and low speed doors between an open and closed position in response to an operator. The mechanism comprises a first pin that extends outwardly from the high speed door at a predetermined height above the pivot. A second pin extends outwardly from the low speed door at a predetermined height above the pivot less than the height of the first pin. Preferably, the predetermined height of the second pin is approximately one-half the predetermined height of the first pin. A drive arm has one end connected pivotally to a lower portion of the elevator car. The drive arm includes at least one slot for receiving the first and second pins therein. The slot extends longitudinally along the drive arm wherein the length of the slot is sufficient to permit relative movement of the pins and drive arm as the high speed and low speed doors move between the open and closed positions and the drive arm pivots. Preferably, the drive arm includes a pair of slots extending longitudinally thereof, whereby each slot engages one of the first and second pins, respectively. The drive arm is weighted to provide a first predetermined closing force to the first pin at the closed position and a second predetermined closing force to the first pin at the open position wherein the second closing force is less than the first closing force.

It is an object of the present invention to provide a two speed door mechanism for an elevator car that provides the required closing force at the closed position and a reduced closing force at the open position.

It is another object of the present invention to provide a two speed door mechanism for an elevator car that reduces the number of parts and thus decreases the cost to manufacture and time to install and assemble the door assembly.

It is yet another object of the present invention to provide a two speed door mechanism for an elevator car that decreases the energy consumption and thus, reduces the heat of the elevator system.

It is still another object of the invention to provide a two speed door mechanism for an elevator car with increased reliability.

The above-discussed and other objects, features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGS..

BEST MODE FOR CARRYING OUT THE INVENTION

Figure 2:
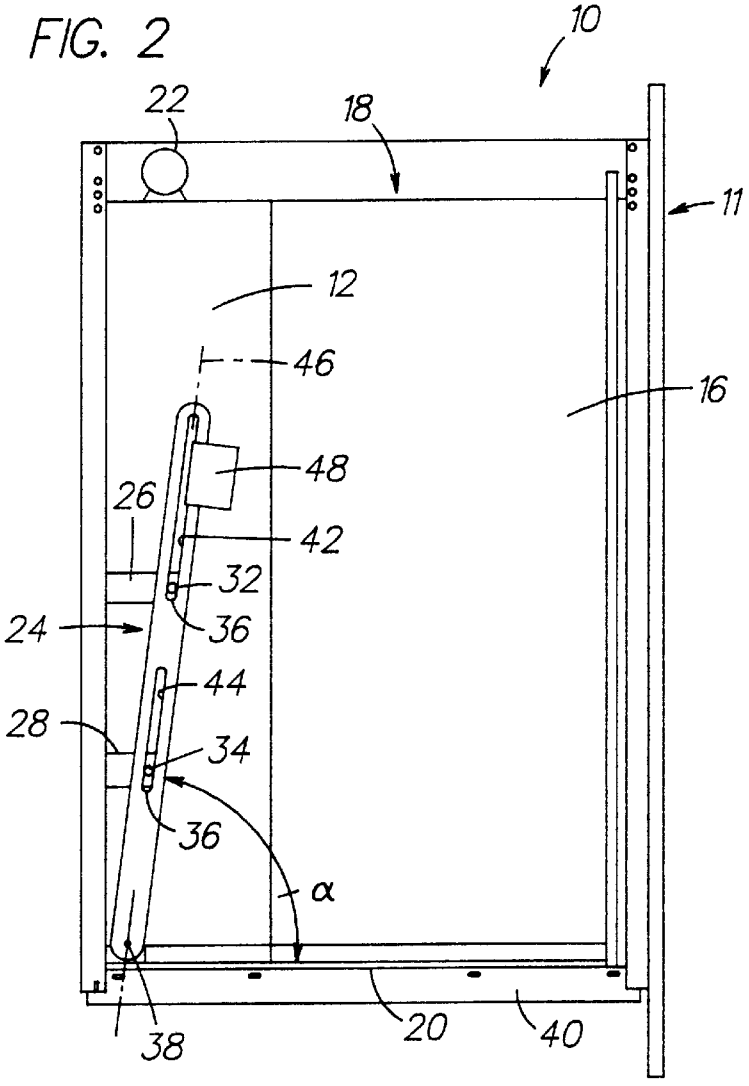
FIG. 2 shows a front elevational view of the door assembly of FIG. 1 having the doors shown at the open position.
Figure 1:
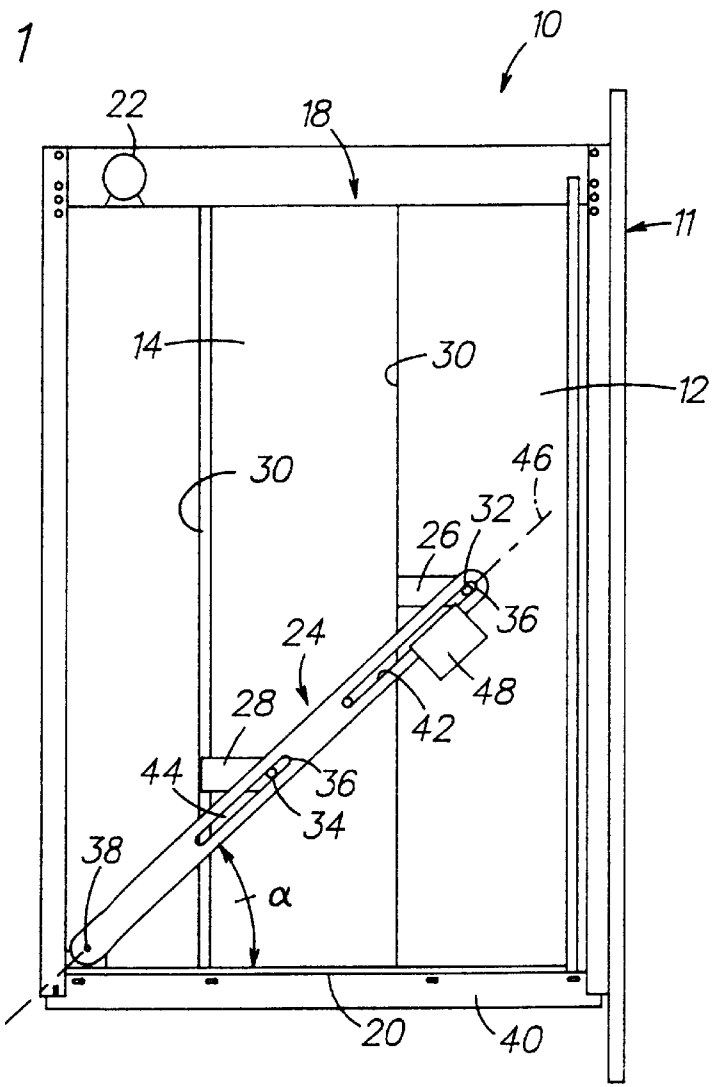
FIG. 1 shows a front elevational view of a door assembly of an elevator car according to a preferred embodiment of the present invention having a pair of doors shown at the closed position.

Referring to FIGS. 1 and 2, it is seen that a door assembly, generally designated 10, for an elevator car 11 is shown at a closed position. The door assembly 10 includes a high speed door 12 and a low speed door 14 that are interconnected to move simultaneously to cover the entrance 16 of the elevator car 11 prior to movement of the car to the desired floor. The doors 12, 14 are retained between a header 18 disposed along the top of the car entrance 16 and a door guide 20 disposed along the bottom of the car entrance. The doors 12, 14 are maintained within a plurality of grooves (not shown) disposed longitudinally along the top surface of the door guide 20 for slidably retaining the doors therein. The top of the doors 12, 14 have rollers for slidably engaging tracks (not shown) disposed in the header 18. A drive mechanism 22 of conventional construction is mounted in the header 18 for moving the doors along the tracks. When actuated by an operator, the drive mechanism exerts a force on the high speed door 12 to move the doors between the open and closed positions.

A drive arm 24 slidably engages both the high speed door 12 and low speed door 14. The drive arm 24 has one end 38 pivotally connected to the door guide 20 or base 40 of the elevator car 11. The interconnection of the doors 12, 14 results in the low speed door 14 moving between the closed and open position concurrently with the movement of the high speed door. Both the high and low speed doors 12, 14 include brackets 26, 28 mounted to the side edge 30 of the respective doors. A pair of pins 32, 34 are attached to or integral with each respective bracket 26, 28 and extend outwardly therefrom for engagement with the drive arm 24. A slider 36 is secured to each of the pins 32, 34 to freely rotate thereabout.

The high speed bracket 26 is attached to the high speed door 12 at a height approximately midway between the header 18 and the pivot 38. The low speed bracket 28 is attached to the low speed door 14 at a height approximately half the height of the high speed bracket 26. The pins 32, 34 of both brackets 26, 28 extend inwardly from the side edge 30 of the doors 12, 14 a predetermined distance so that the drive arm 24 engaging the pins is positioned at an angle $\alpha$, preferably, less than 90 degrees relative to the door guide 20 when the doors are at the closed position as shown in FIG. 2. The angle $\alpha$ of the drive arm 24 is preferably less than 90 degrees at the open position to maintain a constant minimal closing force against the high speed pin 32 without the aid of motor force. The minimal closing force in the open position ensures constant engagement of the high speed pin with the drive arm 24.

The drive arm 24 includes a pair of longitudinal slots 42, 44 disposed along the longitudinal axis 46 of the drive arm. The slot 42 receives the high speed pin 32 and slider 36, and the slot 44 receives the low speed pin 34 and slider 36. The pins and sliders slide along the respective slots 42, 44 as the drive arm 24 pivots when the doors 12, 14 travel between the open and closed positions. It should be recognized that the drive arm 24 may include a single slot that extends longitudinally for slidably engaging both the high and slow speed pins 32, 34.

A block 48 having a predetermined mass is attached to or integral with the drive arm 24. The mass, position of the block 48 along the drive arm 24, and offset from the longitudinal axis 46 is important to provide sufficient closing force to the doors 12, 14 when the doors are at the closed position and a relatively low closing force when the doors are at the open position. The closing force acting on the doors 12, 14 may therefore, be adjusted by adding mass to the drive arm, repositioning the mass along drive arm, and/or both. The effect of the block 48 and its location to the closing force will be evident from the calculations of these forces shown hereinafter.

In the operation of the door assembly 10, an operator controls the actuation of the drive mechanism 22 to open and close the doors 12, 14. Beginning with the doors 12, 14 at the open position shown in FIG. 2, the drive mechanism 22 moves the high speed door 12 to the closed position at a predetermined rate. As the high speed door 12 moves forward, the high speed pin 32 and slider 36 exert a force on the drive arm 24 to pivot the drive arm clockwise. As the drive arm 24 pivots, the high speed pin and slider slide longitudinally within slot 42 of the drive arm. In addition, the drive arm exerts a force on the pin 34 and slider 36 of the low speed door 12, resulting in the closure of the low speed door 12 at approximately one-half the rate of travel of the high speed door 14.

When the doors 12, 14 are in the closed position (see FIG. 1) and the operator actuates the driver mechanism 22 to open the doors, the driver mechanism moves the high speed door 12 back to the open position at a predetermined rate. As the high speed door moves backward, its pin 32 and slider 36 exert a force on the drive arm 24 to pivot the drive arm counterclockwise. As the drive arm 24 pivots counterclockwise, the high speed pin 34 and slider 36 slide longitudinally within the slot 34 of the drive arm. Concurrently, the drive arm exerts a force on the pin 34 of the low speed door 14 to return it to the closed position at approximately one-half the rate of travel of the high speed door 14.

A benefit of the drive arm 24 is that it exerts a closing force on the doors 12, 14 at the closed position that complies with elevator codes, and exerts a reduced closing force on the doors 12, 14 at the open position. The reduced closing force in the open position results in minimal closing force needed to be overcome by the driver mechanism 22 when holding the doors open.

Figure 3:
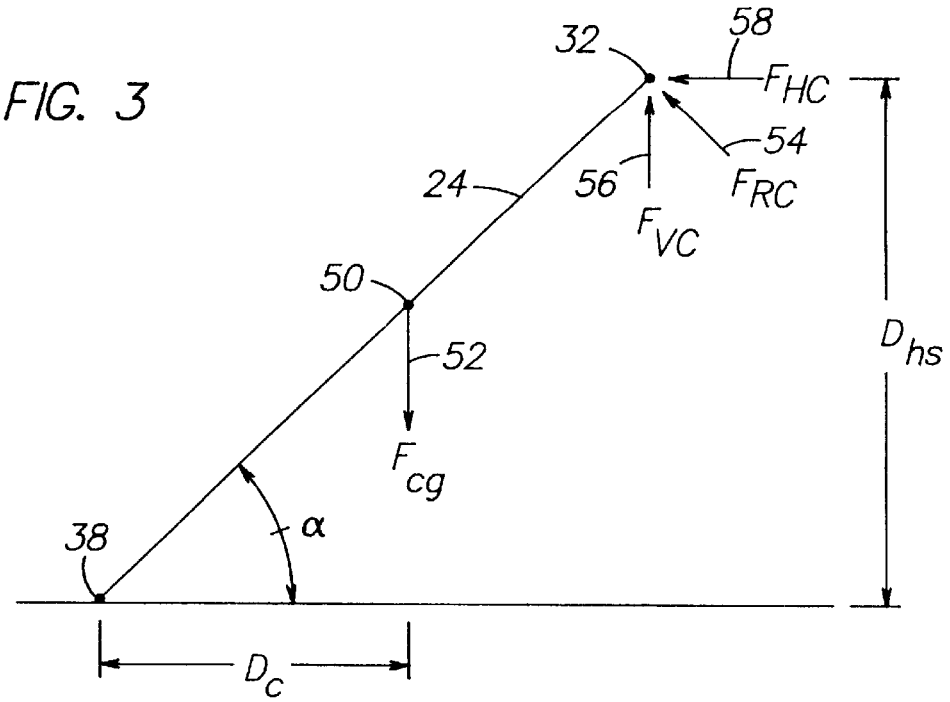
FIG. 3 shows a vector diagram of the forces exerted on a drive arm of the door assembly shown at the closed position in FIG. 1.
Figure 4:
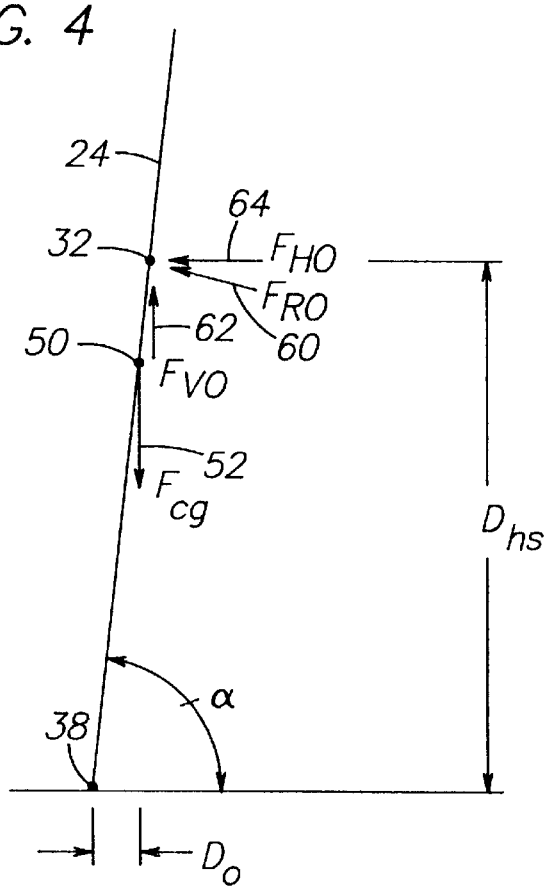
FIG. 4 shows a vector diagram of the forces exerted on the drive arm of the door assembly shown at the open position in FIG. 2.

Referring to FIGS. 3 and 4, the forces exerted on the drive arm 24 are illustrated when the drive arm is disposed at the fully closed and open positions, respectively. The vertical force ($F_{cg}$) acting on the drive arm at its center of gravity 50 is represented by vector 52. As shown in FIG. 3, the resulting force ($F_{RC}$) of the high speed pin 32 acting on the drive arm 24 at the closed position is represented by vector 54. The resulting force ($F_{RC}$) is the sum of the vertical force ($F_{VC}$) and the horizontal force ($F_{HC}$) which are represented by vectors 56 and 58 respectively. The horizontal force ($F_{HC}$) represents the closing force acting on the high speed door 12, to maintain the doors at the closed position. As shown in FIG. 4, the resulting force ($F_{RO}$) of the high speed pin 32 acting on the drive arm 24 at the open position is represented by vector 60. The resulting force ($F_{RO}$) is the sum of the vertical force ($F_{VO}$) and the horizontal force ($F_{HO}$) which are represented by vectors 62 and 64 respectively. The horizontal force ($F_{HO}$) represents the closing force acting on the high speed door 12, urging the doors to the closed position.

The following calculations illustrate the closing force ($F_{HC}$, $F_{HO}$) exerted on the doors 12, 14 in the closed and open positions, respectively, as discussed hereinbefore. The closing forces ($F_{HC}$, $F_{HO}$) exerted by the driver arm 24 can be determined by summing the moments about the pivot point at 38 which is represented by equations:

In the fully closed position, $$(W_{cg})(D_c)-(F_{RC})(D_{hs}/\sin\alpha_c)=0 \quad \text{(Eq.1)}$$

$$F_{HC}=(F_{RC})(\sin\alpha_c) \quad \text{(Eq.2)}$$

In the fully open position, $$(W_{cg})(D_o)-(F_{RO})(D_{hs}/\sin\alpha_o)=0 \quad \text{(Eq.3)}$$

$$F_{HO}=(F_{RO})(\sin\alpha_o) \quad \text{(Eq.4)}$$

Assuming the following conditions:

$w_{cg}$=8.89 Kg (combined weight of drive arm and block at the center of gravity)

$D_C$=68.43 cm (horizontal distance from the pivot to the center of gravity)

$D_o$=12.7 cm (horizontal distance from the pivot to the center of gravity)

$D_{hs}$=116.33 cm (vertical distance from the pivot to the high speed door pin)

$\alpha_o$=83.0 degrees, (angle between the door guide and the drive arm at open position)

$\alpha_c$=43.9 degrees, (angle between the door guide and the drive arm at closed position)

Solving for equations 1 and 2, $F_{RC}$ =[(8.89 Kg)(68.43 cm)][(sin 43.9°)/(116.33 cm)]= 3.62 Kg and therefore, $F_{HC}=(F_{RC})(\sin\alpha_c)$=3.62 Kg (sin 43.9°)=2.49 Kg (closing force at closed position)

Solving for equations 3 and 4, $F_{RO}$=[(8.89 Kg)(12.7 cm)][(sin 83.0°)/(116.33 cm) ]=0.96 Kg and therefore, $F_{HO}=(F_{RO})(\sin\alpha_o)$=0.96 Kg (sin 83.0°)= 0.95 Kg (closing force at open position)

It should be noted that the closing force ($F_{HC}$) of the drive arm 24 at the closed position is 2.49 Kg which is less than the closing force ($F_{HO}$) of 0.95 Kg at the open position.

It should be recognized that the assumed values of the above variables may be varied according to the dimensions of the doors and the desired closing forces required at the open and closed positions. For example, the combined weight or force ($F_{cg}$) at the center of gravity 52 may be changed by altering the position of the block 50 along the drive arm and/or the mass of the block.

While referred embodiments have been shown and described, various modifications and substitutions may be made thereto without departing from the spirit and scope of the invention. Accordingly, it is to be understood that the present invention has been described by way of illustration and not limitation.

We claim:

1. A door mechanism for a door assembly of an elevator car having a motor drive mechanism for moving a high speed and low speed door between an open and closed position; the door mechanism comprising:

a pivot disposed at a lower portion of the elevator car;

a first pin extending outward from the high speed door at a predetermined height above the pivot;

a second pin extending outward from the low speed door at a predetermined height above the pivot; and a drive arm having one end pivotally connected to the pivot of the elevator car, said drive arm including at least one slot, said first and second pins slidably engaging said at least one slot of said drive arm, said slot extending longitudinally along said drive arm having a length to permit movement of the high speed and low speed doors between the open and closed positions, said drive arm having sufficient weight to provide a first predetermined closing force to said first pin at the closed position and a second predetermined closing force to said first pin at the open position wherein the second closing force is less than the first closing force.

2. A door mechanism, as defined in claim 1, wherein the first pin is disposed at approximately one half the height of the high speed door.

3. A door mechanism, as defined in claim 1, wherein the predetermined height of said second pin is approximately one half the predetermined height of said first pin from the pivot.

4. A door mechanism, as defined in claim 1, further includes:

a first bracket mounted to the high speed door wherein said first pin extends from said first bracket; and a second bracket mounted to the low speed door wherein said second pin extends from said second bracket.

5. A door mechanism, as defined in claim 1, further includes a block attached to said drive arm at a predetermined location having a predetermined weight to provide sufficient closing force in the closed position.

6. A door mechanism, as defined in claim 1, wherein said first and second pins are disposed inwardly at a predetermined distance from a side of the high speed and low speed doors, respectively, wherein said drive arm is disposed at an angle with respect to a horizontal plane passing through said pivot that is less than 90 degrees in the closed position.

7. A door assembly for an elevator car; said door assembly comprising:

a high speed door slidably engaging the elevator car;

a slow speed door slidably engaging the elevator car;

a motor drive mechanism for moving said high speed and low speed doors between an open and closed position;

a pivot disposed at a lower portion of the elevator car;

a first pin extending outward from said high speed door at a predetermined height above the pivot of the elevator car;

a second pin extending outward from said low speed door at a predetermined height above the pivot of the elevator car; and a drive arm having one end pivotally connected to the pivot of the elevator car, said drive arm including at least one slot, said first and second pins slidably engaging said at least one slot of said drive arm, said slot extending longitudinally along said drive arm having a length to permit movement of said high speed and low speed doors between the open and closed positions, said drive arm having sufficient weight to provide a first predetermined closing force to said first pin at the closed position and a second predetermined closing force to said first pin at the open position wherein the second closing force is less than the first closing force.

8. A door assembly, as defined in claim 7, wherein the predetermined height of said first pin is approximately one half the height of said high speed door.

9. A door assembly, as defined in claim 7, wherein the predetermined height of said second pin is approximately one half the predetermined height of said first pin from the pivot.

10. A door assembly, as defined in claim 7, further includes:

a first bracket mounted to said high speed door wherein said first pin extends from said first bracket; and a second bracket mounted to said low speed door wherein said second pin extends from said second bracket.

11. A door assembly, as defined in claim 7, further includes a block attached to said drive arm at a predetermined location having a predetermined weight to provide sufficient closing force.

12. A door assembly for an elevator car; said door assembly comprising:

a high speed door slidably engaging the elevator car;

a slow speed door slidably engaging the elevator car;

a motor drive mechanism for moving said high speed and low speed doors between an open and closed position;

a pivot disposed at a lower portion of the elevator car;

a first pin extending outward from said high speed door at a predetermined height above the pivot of the elevator car;

a second pin extending outward from said low speed door at a predetermined height above the pivot of the elevator car; and a drive arm having one end pivotally connected to the pivot of the elevator car, said drive arm including at least one slot for receiving said first and second pins therein, said slot extending longitudinally along said drive arm having a length to permit movement of said high speed and low speed doors between the open and closed positions, said drive arm having sufficient weight to provide a first predetermined closing force to said first pin at the closed position and a second predetermined closing force to said first pin at the open position wherein the second closing force is less than the first closing force, wherein said drive arm further includes a second slot extending longitudinally along said drive arm for slidably receiving said second pin therein, said first slot slidably receiving said first pin therein, said first and second slots having a length to permit movement of said high speed and low speed doors, respectively, between the open and closed positions.

13. A door assembly, as defined in claim 7, wherein said first and second pins are disposed inwardly at a predetermined distance from a side of said high speed and low speed doors, respectively, wherein said drive arm is disposed at an angle with respect to a horizontal plane passing through said pivot that is less than 90 degrees in the closed position.

14. A door mechanism; for a door assembly of an elevator car having a motor drive mechanism for moving a high speed and low speed door between an open and closed position; the door mechanism comprising:

a pivot disposed at a lower portion of the elevator car;

a first pin extending outward from the high speed door at a predetermined height above the pivot;

a second pin extending outward from the low speed door at a predetermined height above the pivot;

a drive arm having one end pivotally connected to the pivot of the elevator car, said drive arm including at least one slot for receiving said first and second pins therein, said slot extending longitudinally along said drive arm having a length to permit movement of the high speed and low speed doors between the open and closed positions, said drive arm having sufficient weight to provide a first predetermined closing force to said first pin at the closed position and a second predetermined closing force to said first pin at the open position wherein the second closing force is less than the first closing force; and a first slider and a second slider being pivotally connected to said first and second pins, respectively, for slidably engaging walls of said slot of said drive arm.

15. A door mechanism for a door assembly of an elevator car having a motor drive mechanism for moving a high speed and low speed door between an open and closed position; the door mechanism comprising:

a pivot disposed at a lower portion of the elevator car;

a first pin extending outward from the high speed door at a predetermined height above the pivot;

a second pin extending outward from the low speed door at a predetermined height above the pivot;

a drive arm having one end pivotally connected to the pivot of the elevator car, said drive arm including at least one slot for receiving said first and second pins therein, said slot extending longitudinally along said drive arm having a length to permit movement of the high speed and low speed doors between the open and closed positions, said drive arm having sufficient weight to provide a first predetermined closing force to said first pin at the closed position and a second predetermined closing force to said first pin at the open position wherein the second closing force is less than the first closing force, wherein said drive arm further includes a second slot extending longitudinally along said drive arm for slidably receiving said second pin therein, said first slot slidably receiving said first pin therein, said first and second slots having a length to permit movement of the high speed and low speed doors, respectively, between the open and closed positions.

16. A door assembly for an elevator car; said door assembly comprising:

a high speed door slidably engaging the elevator car;

a slow speed door slidably engaging the elevator car;

a motor drive mechanism for moving said high speed and low speed doors between an open and closed position;

a pivot disposed at a lower portion of the elevator car;

a first pin extending outward from said high speed door at a predetermined height above the pivot of the elevator car;

a second pin extending outward from said low speed door at a predetermined height above the pivot of the elevator car;

a drive arm having one end pivotally connected to the pivot of the elevator car, said drive arm including at least one slot for receiving said first and second pins therein, said slot extending longitudinally along said drive arm having a length to permit movement of said high speed and low speed doors between the open and closed positions, said drive arm having sufficient weight to provide a first predetermined closing force to said first pin at the closed position and a second predetermined closing force to said first pin at the open position wherein the second closing force is less than the first closing force; and a pair of sliders, one of each sliders being pivotally connected to said first and second pins for slidably engaging walls of said slot of said drive arm.

17. A door mechanism for a door assembly of an elevator car having a motor drive mechanism for moving a high speed and low speed door between an open and closed position; the door mechanism comprising:

a pivot disposed at a lower portion of the elevator car;

a first pin extending outward from the high speed door at a predetermined height above the pivot;

a second pin extending outward from the low speed door at a predetermined height above the pivot; and a drive arm having one end pivotally connected to the pivot of the elevator car, said drive arm including at least one slot for receiving said first and second pins therein, said slot extending longitudinally along said drive arm having a length to permit movement of the high speed and low speed doors between the open and closed positions, said drive arm having sufficient weight to provide a first predetermined closing force to said first pin at the closed position and a second predetermined closing force to said first pin at the open position wherein the second closing force is less than the first closing force, wherein said first and second pins are disposed inwardly at a predetermined distance from a side of the high speed and low speed doors, respectively, wherein said drive arm is disposed at an angle with respect to a horizontal plane passing through said pivot that is less than 90 degrees in the open position.

18. A door assembly for an elevator car; said door assembly comprising:

a high speed door slidably engaging the elevator car;

a slow speed door slidably engaging the elevator car;

a motor drive mechanism for moving said high speed and low speed doors between an open and closed position;

a pivot disposed at a lower portion of the elevator car;

a first pin extending outward from said high speed door at a predetermined height above the pivot of the elevator car;

a second pin extending outward from said low speed door at a predetermined height above the pivot of the elevator car; and a drive arm having one end pivotally connected to the pivot of the elevator car, said drive arm including at least one slot for receiving said first and second pins therein, said slot extending longitudinally along said drive arm having a length to permit movement of said high speed and low speed doors between the open and closed positions, said drive arm having sufficient weight to provide a first predetermined closing force to said first pin at the closed position and a second predetermined closing force to said first pin at the open position wherein the second closing force is less than the first closing force, wherein said first and second pins are disposed inwardly at a predetermined distance from a side of said high speed and low speed doors, respectively, wherein said drive arm is disposed at an angle with respect to a horizontal plane passing through said pivot that is less than 90 degrees in the open position.

* * * * *